US007080748B2

(12) United States Patent
Sasaki et al.

(10) Patent No.: US 7,080,748 B2
(45) Date of Patent: Jul. 25, 2006

(54) BOTTLE-SHAPED CONTAINER MADE OF SYNTHETIC RESIN HAVING GRIP PORTIONS

(75) Inventors: Masaaki Sasaki, Matsudo (JP); Takao Iizuka, Koto-Ku (JP)

(73) Assignee: Yoshino Kogyosho Co., Ltd., Tokyo (JP)

( * ) Notice: Subject to any disclaimer, the term of this patent is extended or adjusted under 35 U.S.C. 154(b) by 190 days.

(21) Appl. No.: 10/473,679

(22) PCT Filed: Mar. 30, 2001

(86) PCT No.: PCT/JP01/02773

§ 371 (c)(1),
(2), (4) Date: Oct. 23, 2003

(87) PCT Pub. No.: WO02/081313

PCT Pub. Date: Oct. 17, 2002

(65) Prior Publication Data

US 2004/0134872 A1 Jul. 15, 2004

(51) Int. Cl.
*B65D 23/10* (2006.01)

(52) U.S. Cl. ..... 215/384; 215/381; 215/398; 220/675; 220/771

(58) Field of Classification Search ..... 215/381, 215/383, 384, 382, 396–398; 220/771, 666, 220/671, 675

See application file for complete search history.

(56) References Cited

U.S. PATENT DOCUMENTS

| | | | | | |
|---|---|---|---|---|---|
| 3,537,498 | A | * | 11/1970 | St. Amand | 604/403 |
| 5,226,550 | A | * | 7/1993 | Mikolaitis et al. | 215/384 |
| 5,392,937 | A | | 2/1995 | Prevot et al. | 215/384 |
| 5,472,105 | A | * | 12/1995 | Krishnakumar et al. | 215/384 |
| D383,067 | S | * | 9/1997 | Gower et al. | D9/520 |
| D420,593 | S | * | 2/2000 | Denner et al. | D9/520 |
| D433,947 | S | * | 11/2000 | Ewing, Jr. | D9/543 |
| 6,164,474 | A | * | 12/2000 | Cheng et al. | 215/384 |
| 6,349,839 | B1 | * | 2/2002 | Mooney | 215/384 |

FOREIGN PATENT DOCUMENTS

| | | |
|---|---|---|
| JP | A 8-318953 | 12/1996 |
| JP | A 10-203520 | 8/1998 |
| JP | A 10-305823 | 11/1998 |
| JP | A 10-329820 | 12/1998 |

* cited by examiner

*Primary Examiner*—Sue A. Weaver
(74) *Attorney, Agent, or Firm*—Oliff & Berridge, PLC

(57) ABSTRACT

A container made of thermoplastic synthetic resin having a central axis extending longitudinally, and having a body, wherein the body has a left and a right symmetrically relating to the central axis, each of the left and right is formed with a distortion-absorbing portion in response to a pressure change in the container, each of the distortion-absorbing portions is formed with a grip portion, and each of the grip portions includes a central portion of the left and the right, has an area an area smaller than an area of the distortion-absorbing portion, and has a depth larger than a depth of the distortion-absorbing portion.

6 Claims, 4 Drawing Sheets

BOTTLE-SHAPED CONTAINER MADE OF SYNTHETIC RESIN HAVING GRIP PORTIONS

BACKGROUND OF INVENTION

The present invention relates to a blow-molded bottle-shaped container made of thermoplastic synthetic resin, and more particularly, a bottle having a grip portion.

It is known that a blow-molded bottle made of thermoplastic synthetic resin has a handle for gripping the bottle on a side of a body thereof. U.S. Pat. No. 5,392,937 discloses a blow-molded bottle having a body wherein said body has a left a right and a rear, said body has a central axis, each of left and right is formed with a grip for receiving a person's thumb and fingers at a position behind the central axis and near the rear.

If such blow-molded bottle has a large volume (for example, 2 liter of content), it is necessary to prevent a wall of the body from deforming due to a pressure reduction in the bottle after filling a liquid content. Thus, it is necessary to provide a distortion-absorbing portion in the wall, and to provide reinforcing ribs in the distortion-absorbing portion. A bottle is grasped by a person's hand from the rear thereof. Thus, it is necessary to arrange a grip portion near the rear. Therefore, the bottle is grasped at a position near the rear in the grip portion. In addition, a palm of the hand is positioned at a rear edge of the grip portion, so that it tends to grasp the bottle by only the fingers. If the bottle has a large volume and is heavy, it may occur to drop the bottle accidentally.

SUMMARY OF THE INVENTION

The present invention provides a container made of thermoplastic synthetic resin having a central axis extending longitudinally, and having a body, wherein said body has a left and a right symmetrically relating to the central axis, each of the left and right is formed with a distortion-absorbing portion in response to a pressure change in the container, each of the distortion-absorbing portions is formed with a grip portion, and each of the grip portions includes a central portion of the left and the right, has an area smaller than an area of the distortion-absorbing portion, and has a depth larger than a depth of the distortion-absorbing portion.

Preferably, the grip portion has the area which is 25% or less of the area of the distortion-absorbing portion. Still preferably, Each of the grip portions may be formed with a plurality of reinforcing ribs extended longitudinally.

Since the present invention has the above described constructions, even if the bottle is heavy and has a large volume of content, such bottle can be surely and safely grasped by the person's thumb, fingers and palm. In addition, according to the present invention, the distortion due to the pressure reduction can be effectively absorbed.

PREFERRED EMBODIMENT

Figure 1:
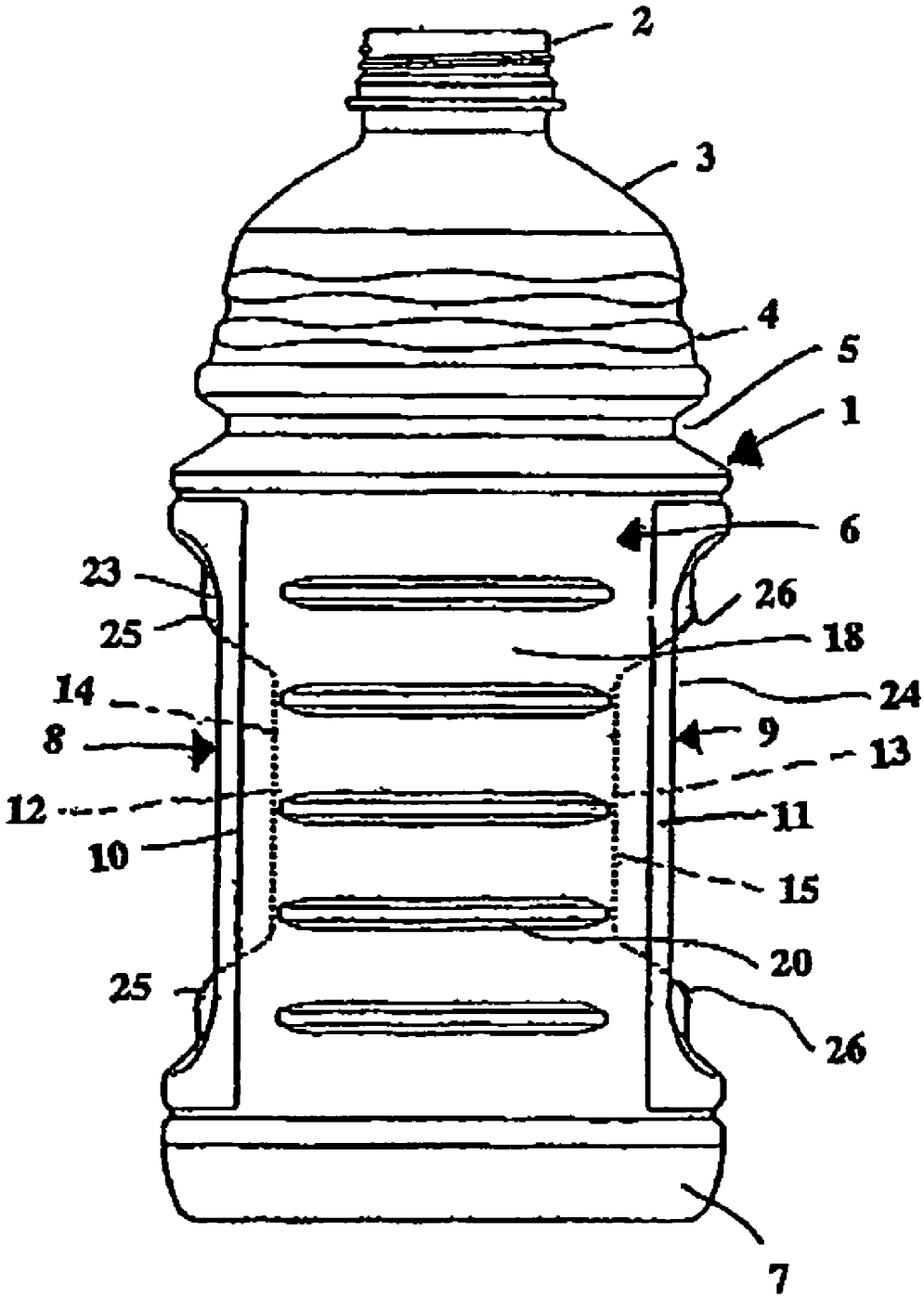
FIG. 1 is a front view of the bottle according to one embodiment of the present invention.
Figure 2:
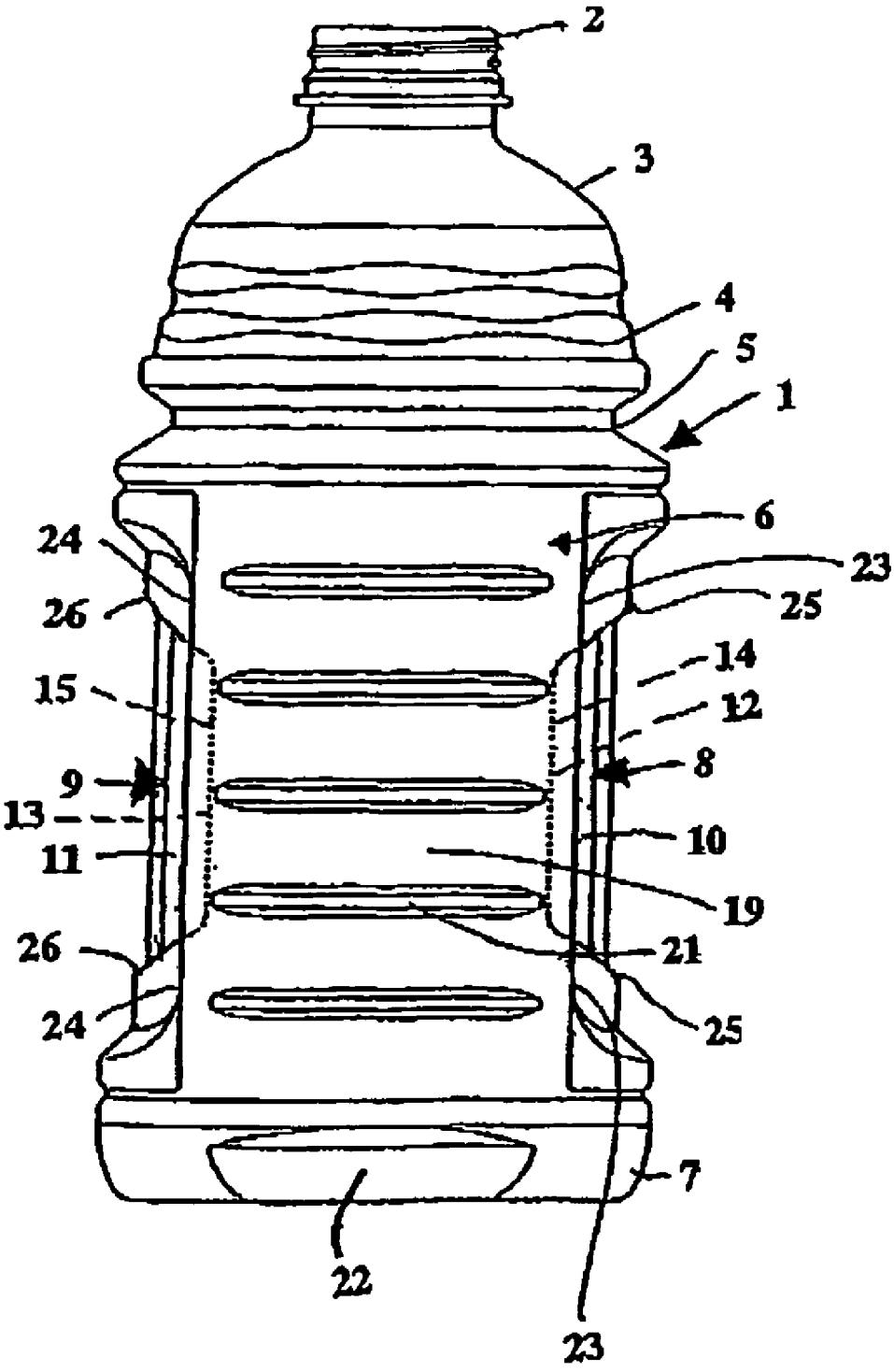
FIG. 2 is a rear view of the bottle illustrated in FIG. 1.
Figure 3:
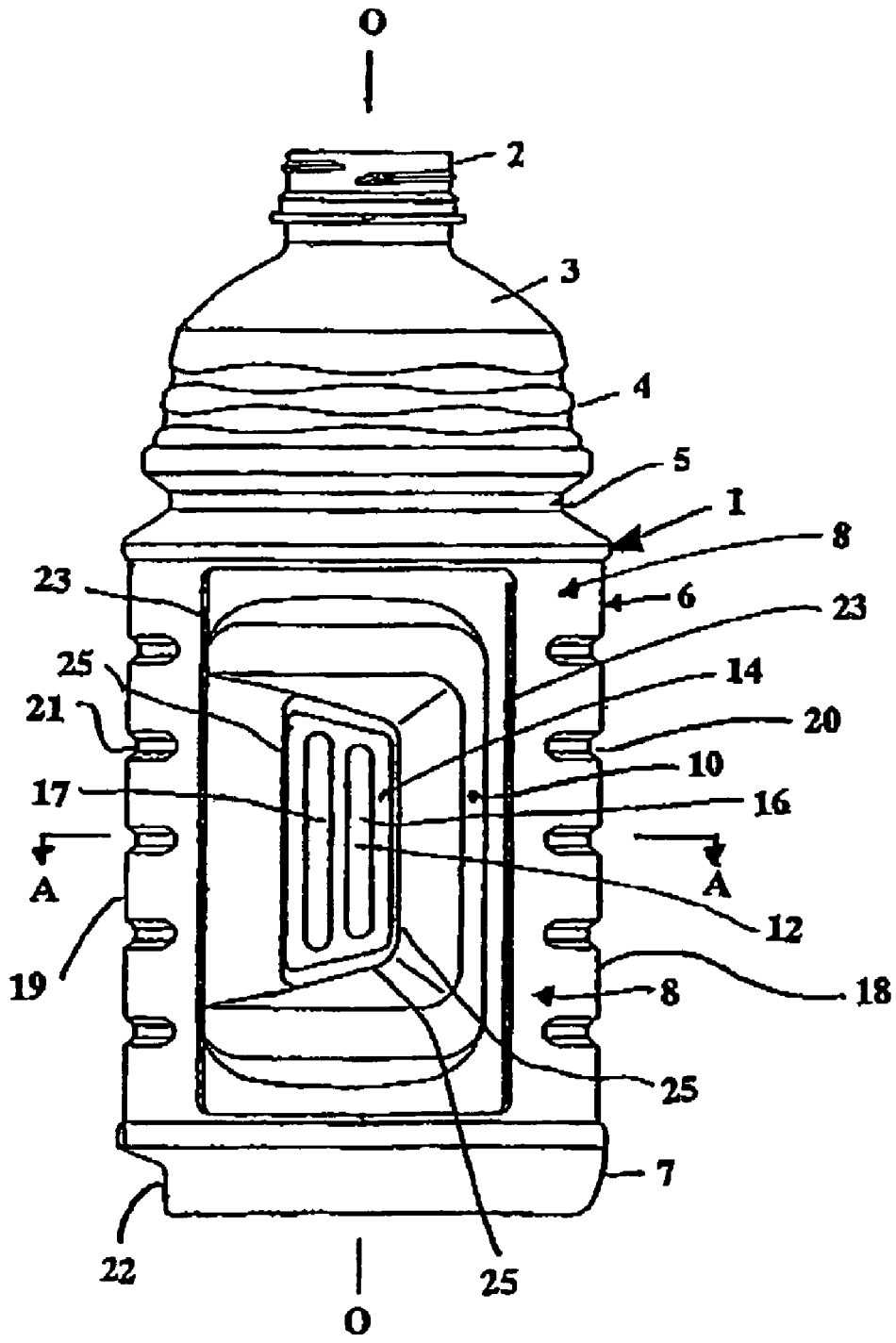
FIG. 3 is a left side view of the bottle illustrated in FIG. 1.

FIGS. 1 to 4 illustrate a preferred embodiment of the present invention An illustrated bottle is made of polyethylene terephthalate, and has 2 liter of volume. Note that the present invention is not limited to a bottle made of polyethylene terephthalate, and includes a bottle made of a synthetic resin.

The illustrated bottle 1 has a cylindrical shape having an elliptical cross-sectional shape. However, the polygonal cross-sectional shape and the elongated polygonal cross-sectional shape may be included in the present invention.

The bottle 1 comprises a neck 2 having a short cylindrical shape, an upper shoulder 3 extended from the neck 2 downwardly, a middle shoulder 4 extended from the upper shoulder 3 downwardly, a reduced-diameter portion 5, a body 6, and a bottom 7 arranged at a lower end of the body 6. The upper shoulder 3 has a diameter which is increased downwardly. The bottom 7 is formed by a known art.

The bottle 1 has a central axis O—O which extends vertically or longitudinally. The body 6 has a front 18 (illustrated in FIG. 1), a rear 19 (illustrated in FIG. 2), a left 8 and a right 9. The left 8 and the right 9 are arranged symmetrically relating to the axis O—O. The left side 8 is formed with a concaved distortion-absorbing portion 10, and the right side 9 is formed with a concaved distortion-absorbing portion 11. If the bottle 1 is filled with a heated content (liquid etc.) and sealed, the body 6 is distorted due to a change of an internal pressure. Each of the portions 10 and 11 absorbs such distortion so as to decrease the deformation.

Each of the distortion-absorbing portions 10 and 11 has central portions 12, 13 which corresponds to the axis O—O. Each of the central portions 12, 13 is formed with a grip portion 14, 15. In other words, each of the grip portions 14, 15 is substantially arranged at a center of each of the distortion-absorbing portions 10, 11. Each of the grip portions 14, 15 has an area smaller than that of each of the distortion-absorbing portions 10, 11. Each of the grip portions 14, 15 is concaved larger than each of the distortion-absorbing portions 10, 11.

Preferably, each of the grip portions 14, 15 has an area that is 25% or less of an area of each of the distortion-absorbing portions 10, 11, so as to easily grip the bottle. In the illustrated embodiment, each of the grip portions 14, 15 has the area that is 20% of the area of each of the distortion-absorbing portions 10, 11.

Each of the grip portions 14, 15 has a concaved depth "DA" which is larger than a concaved depth "DB" of each of the distortion-absorbing portions 10, 11.

Each of the grip portions 14, 15 is formed with protruded ribs 16, 17 extended longitudinally. Each of the ribs 16, 17 prevents from slipping when the bottle is gripped, and increases strength against distortion-deformation.

Preferably, the rear 19 has a width "W" (see FIG. 4) which is 90 mm or less. If the width is more than 90 mm, it is difficult to grasp the bottle.

Each of the front 18 and rear 19 is formed with recessed strips 20, 21. In the illustrated embodiment, each of the front 18 and rear 19 is formed with five recessed strips 20, 21 which are arranged in parallel one another. Each of the recessed strips 20, 21 is a reinforcing rib, and prevents from distorting the front 18 and rear 19. The reinforcing rib may be a protruded strip. In view of an application of a label to the front or the rear, a recessed strip is preferable.

The bottom 7 is formed with a concaved portion 22 at a lower portion of the rear 19. The concaved portion 22 aligns bottles 1 on conveying the bottles.

Each of the distortion-absorbing portions 10, 11 has a ridge 23, 24 at a periphery thereof. Each of the grip portions 14, 15 has a ridge 25, 26 at a periphery thereof Each of the ridges 23, 24, 25, 26 increases strength against distortion deformation of the entire distortion-absorbing portion 10, 11.

Figure 4:
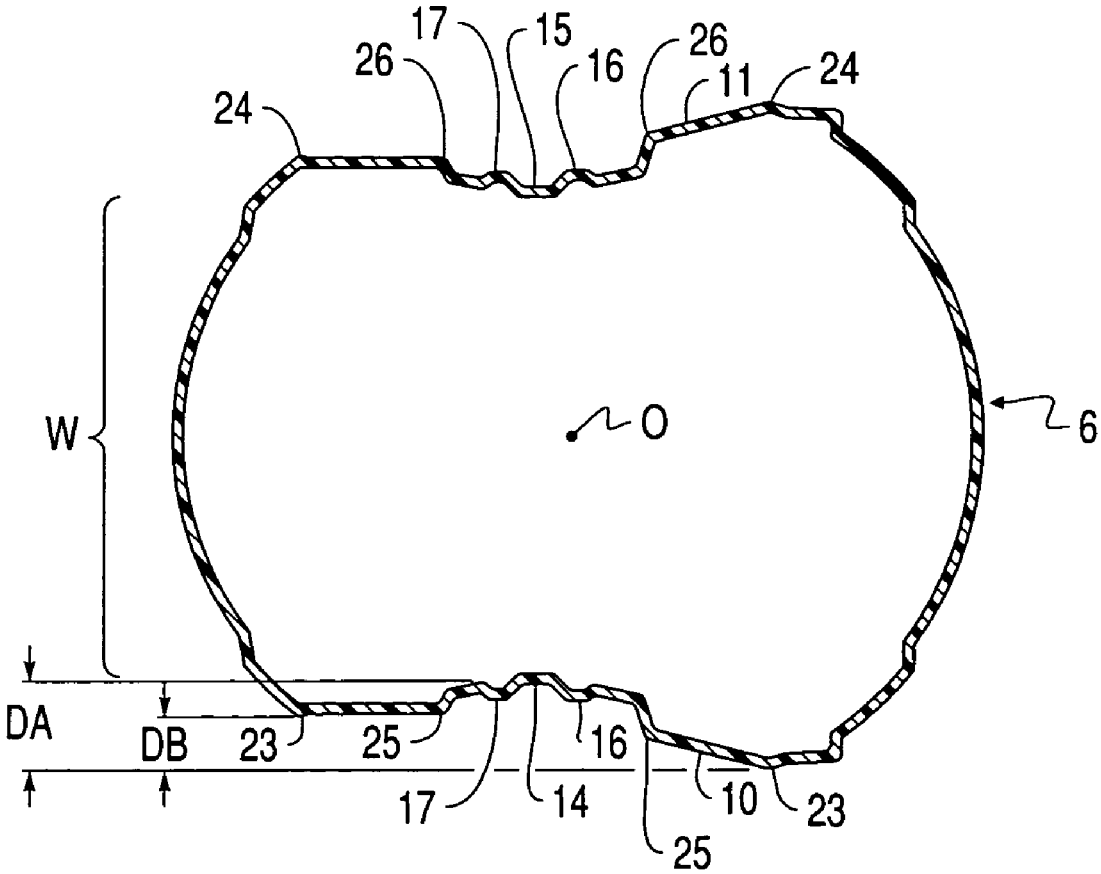
FIG. 4 is a cross-sectional view of the bottle cut along A—A in FIG. 3, and illustrates a thickness of the bottle exaggeratively.

In FIG. 4, note that a thickness of the bottle 1 is exaggeratively illustrated. Thus, upon understanding the present invention, the thickness of the bottle should be understood to be thinner.

What is claimed is:

1. A container made of thermoplastic synthetic resin having a central axis extending longitudinally, the container comprising:

a body, the body having a left and a right symmetrically arranged relative to the central axis, each of the left and the right being formed with a distortion-absorbing portion that absorbs distortion in response to a pressure change in the container, each of the distortion-absorbing portions being formed with a single grip portion, and each of the grip portions including a plurality of ribs and a central portion of the left and the right, each of the grip portions having an area smaller than an area of the distortion-absorbing portion, and a depth larger than a depth of the distortion-absorbing portion, each of the grip portions being formed with the plurality of ribs extended longitudinally along each of the grip portions without a transverse rib provided in the grip portions, and each of the grip portions being formed at approximately the center of the distortion-absorbing portion.

2. The container according to the claim 1, wherein the grip portion has the area which is 25% or less of the area of the distortion-absorbing portion.

3. The container according to claim 1, wherein the body further includes a front and a rear.

4. The container according to claim 3, wherein the rear of the body has a width less than 90 mm.

5. The container according to claim 4, wherein the front and the rear includes a plurality of recessed strips that extend horizontally.

6. A container made of thermoplastic synthetic resin having a central axis extending longitudinally, the container comprising:

a body, the body having a left and a right symmetrically arranged relative to the central axis, each of the left and the right being formed with a distortion-absorbing portion that absorbs distortion in response to a pressure change in the container, each of the distortion-absorbing portions being formed with a grip portion, and each of the grip portions including a plurality of ribs and a central portion of the left and the right, each of the grip portions having an area smaller than an area of the distortion-absorbing portion, and a depth larger than a depth of the distortion-absorbing portion, each of the grip portions being formed with the plurality of ribs extended longitudinally along each of the grip portions, each of the grip portions being formed at approximately the center of the distortion-absorbing portion, and wherein the grip portion has the area which is 25% or less of the area of the distortion-absorbing portion.

* * * * *